US008932108B2

(12) United States Patent
Ma et al.

(10) Patent No.: US 8,932,108 B2
(45) Date of Patent: Jan. 13, 2015

(54) HIGH SPEED BARREL POLISHING DEVICE

(75) Inventors: Yuanfeng Ma, Shenzhen (CN); Linlang Wu, Shenzhen (CN); Sheng Zhang, Shenzhen (CN)

(73) Assignee: International Business Machines Corporation, Armonk, NY (US)

( * ) Notice: Subject to any disclaimer, the term of this patent is extended or adjusted under 35 U.S.C. 154(b) by 893 days.

(21) Appl. No.: 13/012,934

(22) Filed: Jan. 25, 2011

(65) Prior Publication Data

US 2011/0256808 A1 Oct. 20, 2011

(30) Foreign Application Priority Data

Apr. 19, 2010 (CN) ..... 2010 1 0153032

(51) Int. Cl.

| | |
|---|---|
| ***B24B 1/00*** | (2006.01) |
| ***B24B 31/02*** | (2006.01) |
| ***B24B 31/023*** | (2006.01) |
| ***B24B 31/033*** | (2006.01) |

(52) U.S. Cl.

CPC ..... *B24B 31/0218* (2013.01); *B24B 31/023* (2013.01); *B24B 31/033* (2013.01)

USPC ..... 451/35; 451/36; 451/41; 451/113; 451/329

(58) Field of Classification Search

CPC .. B24B 31/00; B24B 31/0218; B24B 31/033; B24B 31/023

USPC ..... 241/175, 177, 179; 451/32, 34, 35, 36, 451/41, 104, 113, 326, 327, 328, 329

See application file for complete search history.

(56) References Cited

U.S. PATENT DOCUMENTS

| | | | | |
|---|---|---|---|---|
| 2,433,872 | A | | 6/1944 | Symons |
| 2,874,911 | A | | 2/1959 | Limb |
| 3,042,322 | A | | 7/1962 | Symons |
| 3,524,735 | A | | 8/1970 | Oetiker |
| 4,073,095 | A | | 2/1978 | Dreher |
| 4,586,292 | A | * | 5/1986 | Carroll et al. ..... 451/329 |
| 4,733,825 | A | | 3/1988 | Boyes et al. |
| 4,850,151 | A | | 7/1989 | Ditscherlein |
| 4,949,510 | A | * | 8/1990 | Kobayashi et al. ..... 451/6 |

(Continued)

FOREIGN PATENT DOCUMENTS

| | | |
|---|---|---|
| CN | 2384738 | 6/2000 |
| CN | 2740348 | 11/2005 |

(Continued)

*Primary Examiner* — Timothy V Eley

(74) *Attorney, Agent, or Firm* — Lieberman & Brandsdorfer, LLC

(57) ABSTRACT

A method useful for polishing a large number of miniature components such as multi-layer electronic components, within a high speed barrel polishing device, is disclosed. In various embodiments of the present invention, a vertical planetary ball mill or other barrel polishing device is modified to rotate polishing containers having a modified interior cavity structure. This interior cavity provides a smooth, gradually curved interior sidewall that improves circulation within the container during high-speed vertical polishing rotation. The improved circulation results in polishing for a larger number of components placed within the container and in less time than existing polishing container structures. In further embodiments, the containers are rotated around a generally tilted axis positioned at an angle between entirely vertical and horizontal positions. Rotation about a tilted axis further reduces collisions and increases relative polishing movement within the container.

6 Claims, 7 Drawing Sheets

(56) References Cited

U.S. PATENT DOCUMENTS

| | | | | |
|---|---|---|---|---|
| 5,211,673 | A | 5/1993 | Ditscherlein | |
| 5,454,749 | A * | 10/1995 | Ohno | 451/329 |
| 5,460,566 | A | 10/1995 | Trahan | |
| 5,486,135 | A * | 1/1996 | Arpaio | 451/326 |
| 5,522,558 | A | 6/1996 | Kaneko | |
| 5,551,779 | A * | 9/1996 | Gantner et al. | 366/217 |
| 6,758,729 | B2 * | 7/2004 | Fujishiro | 451/328 |
| 6,843,260 | B2 | 1/2005 | Trahan | |
| 7,883,396 | B2 * | 2/2011 | Potterfield et al. | 451/326 |
| 8,092,075 | B2 * | 1/2012 | Ishii | 366/139 |
| 2008/0197223 | A1 | 8/2008 | Nagao | |
| 2009/0281663 | A1 * | 11/2009 | Robida | 700/265 |

FOREIGN PATENT DOCUMENTS

| | | |
|---|---|---|
| CN | 1745899 | 3/2006 |
| CN | 200939577 | 8/2007 |
| CN | 201092006 | 7/2008 |
| JP | 2005074547 | 3/2005 |

* cited by examiner

HIGH SPEED BARREL POLISHING DEVICE

CROSS REFERENCE TO RELATED APPLICATIONS

This application claims priority to Chinese patent application number 201010153032.7, filed Apr. 19, 2010, the content of which is hereby incorporated by reference in its entirety.

FIELD OF THE INVENTION

The present invention generally relates to mechanical polishing devices. The present invention more specifically relates to a polishing device useful for polishing a plurality of components such as a batch of multi-layer electronic components.

BACKGROUND OF THE INVENTION

Barrel polishing is a common step performed during the manufacturing process of multi-layer electronic components, for components such as inductors, beads, capacitors, and oscillators. Polishing is necessary in order to round the corners and remove sharp edges from these components. Current polishing processes typically place a large number of components inside of a horizontal, rotating barrel, and expose the components to an abrasive that slowly polishes the edges of the components as the contents of the barrel are rotated.

There are many limitations of existing polishing devices when used for polishing multi-layer electronic components. Horizontal barrel devices must be operated at low speed in order to prevent damage to components, which results in a long polishing process. Other types of devices that are used to polish large mechanical workpieces, printed circuit boards, or semiconductor wafers generally cannot be used with small, multi-layer components. Many of these polishing devices often result in uneven polishing or damage to multi-layer electronic components.

Conventional horizontal-type barrel finishing systems are big and heavy, relatively inefficient, and do not provide polishing speed as fast as vertically oriented barrel finishing systems. For example, a horizontal barrel polishing process for multi-layer electronic components may take twelve hours for a single batch of components. This results in a longer floor to floor time for the overall manufacturing process. Horizontal barrel polishing techniques may also cause severe collisions due to the combination of gravity, revolution centrifugal force, and rotation centrifugal force.

Vertical barrel polishing techniques generally result in fewer collisions and therefore cause less damage than horizontal techniques. Some vertical barrel finishing devices exist in the art but have not been effectively adapted for use in electronic component polishing. For example, vertical planetary ball mills may be used to grind or mix solid particles of different granularities and materials, with use of both dry and wet methods. When vertical planetary ball mills are used for barrel polishing, however, all of the components will fail to properly circulate within the barrel which results in incomplete polishing batches.

What is needed is a low cost, high speed barrel polishing device useful for polishing multi-layer electronic components. The present invention provides such a device that can achieve uniform polishing, while reducing the incidence of cracking and damage during the barrel polishing process.

BRIEF SUMMARY OF THE INVENTION

One aspect of the present invention includes providing a high speed vertical barrel polishing device and high speed polishing containers that may be used for barrel polishing in a variety of applications, such as a multi-layer electronic component manufacturing process. Specifically, various embodiments of the presently described polishing device are capable of rotating a set of one or more containers around a generally vertical axis with higher speeds and less damage than provided by barreling techniques around a generally horizontal axis.

In one embodiment, polishing containers (also referred to in the art as "canisters", "jars", or "pots") are adapted for use within a generally vertically rotating barrel polishing device, such as a planetary ball mill. The polishing containers are then rotated at high speed to polish items placed inside such as multi-layer electronic components. Whereas typical polishing containers in a straight, vertical cylinder shape may fail to polish all components placed within the container, the interior shape of the container provided by one embodiment of the present invention enables improved agitation and circulation and therefore improved polishing capabilities. In one embodiment, the internal cavity of the container is defined by an inner bottom with gradually sloped upward edges to enable components to fly up during the rotation of the container. The diameter of the internal cavity is larger within its central section, while becoming gradually smaller towards both of the top and bottom of the container. In a further embodiment, the internal cavity also contains a substantially flat bottom surface in order to keep the container stable during high-speed rotation.

As suggested, in one embodiment of the present invention, a vertical planetary ball mill may be adapted for use with a set of containers having this modified internal cavity structure. The vertical planetary ball mill therefore can simultaneously operate a number of vertically rotating polishing containers, each filled with the same or different components. Further, the containers of the vertical planetary ball mill can be configured to operate with a hermetic, watertight sealed construction. Therefore, the containers may be filled and successfully operated at high speed with a number of varying wet and dry materials, such as dry polishing media, abrasives, and various types of liquids.

A further embodiment of the present invention provides for operation of a vertical planetary ball mill that rotates the polishing containers at a tilted angle around a set of tilted axes. The tilted axes that the containers and the revolution plate revolve about are not parallel to (i.e., are different from) the axis extending through a support member or other fixed vertical reference point. The angle between the support member and the tilted axis is generally referred to herein as the "tilted angle" of operation. In one embodiment the tilted angle is a substantially 45 degree angle, thereby allowing typical operation in a midpoint between entirely horizontal and vertical positions. Rotation around a tilted axis between horizontal and vertical positions further decreases accumulation of components at the bottom of the container and increases relative movements within the container during polishing. Further, rotation around the tilted axis reduces collision forces that would otherwise occur during a horizontally-oriented barrel polishing process.

A high speed polishing device provided according to one embodiment includes a revolution plate structured for rotation around a revolution plate axis in a first direction, and a plurality of modified polishing containers used for polishing components placed inside the containers, with each of the polishing containers coupled to the top side of the revolution plate and structured for rotation around a corresponding container axis in a second direction. The first direction of revolution plate rotation (e.g., clockwise) is opposite the second direction of container rotation (e.g., counter-clockwise). Each of the container axes and the plate axis are generally vertical during operation of the polishing device, with all of the container axes being parallel to the plate axis. The interior structure of each of the plurality of polishing containers comprises an interior cavity having a first end (e.g., a bottom) and a second end (e.g., a top), wherein the interior cavity is defined by a generally smooth interior wall with an internal diameter that continuously varies and provides a gradual transition (such as with a curved wall) between the first end and the second end of the cavity.

In further embodiments, this gradual transition between the first end and the second end of the container interior cavity includes a first transition between the first end and a central widest point existing between the first end and the second end, and a second transition in an opposite direction of the first transition between the central widest point and the second end. This provides a generally curved interior structure between the first end and second end without any corners or crevices for components to encounter during polishing. This central widest point is not necessarily an equal distance between the first and second ends, but rather may be located either closer to the first or second ends. In still another embodiment, the first end (e.g., bottom) of the interior cavity is defined by a substantially flat surface to promote high-speed rotational stability of the container.

As previously suggested, in further embodiments the containers of the high speed polishing device may be operated at a tilted axis positioned generally between entirely horizontal and vertical positions. Specifically, each of the plate axis and the container axis may be positioned to operate at a tilted angle position, the tilted angle defined as the angle between the plate or container axes and the axis that extends through a support member, base, rotation assembly, or other fixed member of the polishing device that is positioned in a generally vertical position. In one embodiment, the tilted angle is set at a substantially 45 degree angle, provided by positioning the plate axis and containers axes at a 45 degree angle acute to the support member axis.

Another embodiment provides a method for polishing components within a high speed polishing device such as the device and/or polishing containers described above. This method includes placing components in one or more of a plurality of polishing containers. Next, a revolution plate is rotated with force provided by a revolution shaft driven directly or indirectly by a motor or similar revolution-generating structure. Further embodiments may include the steps of adding dry abrasives to the container; adding a liquid to the polishing container and sealing the container; and operating the polishing containers at a tilted angle (e.g., 45 degrees between a fully horizontal and fully vertical position) as generally described herein.

DETAILED DESCRIPTION OF THE INVENTION

The present invention provides improved polishing devices and techniques useful during a generally vertically-oriented barrel polishing process. The presently disclosed high speed barrel polishing apparatus and modified barrel polishing container is particularly useful for polishing a large number of components, such as hundreds or thousands of small electronic components, in a relatively rapid fashion.

Some of the other advantages of the various embodiments of the present invention include providing uniform polishing, higher speed, and the use of low cost equipment. Existing vertical planetary ball mill machines may be adapted to provide vertical polishing capabilities in a relatively small space with a small number of modifications. Other advantages of the various embodiments of the present invention include providing a barrel polishing techniques which expose the polished components to less gravitational forces and collisions, thus resulting in reduced cracking and damage to the components. Additionally, use of sealed, airtight containers within a planetary ball mill enables both wet and dry type polishing.

Figure 1A:
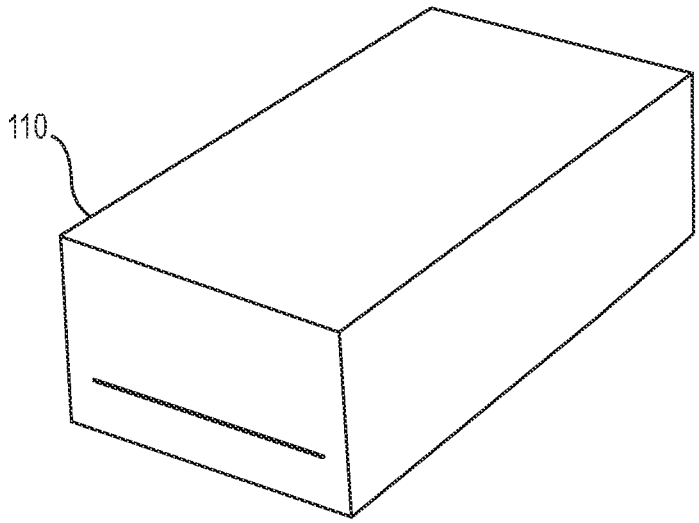
FIG. 1A provides an illustration of an unpolished multi-layer electronic component.
Figure 1B:
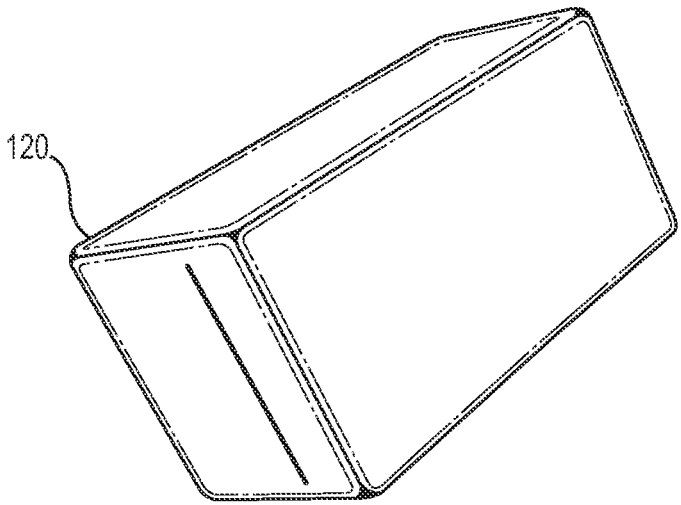
FIG. 1B provides an illustration of a polished multi-layer electronic component.

Multi-layer electronic components such as inductors, beads, capacitors, and oscillators often require a polishing step in their fabrication or manufacturing process. Specifically, such components must have rounded and not sharp edges to ensure proper plating. An unpolished, multi-layer electronic component 110 made from ceramic or a similar type of hardened material is illustrated in FIG. 1A. In contrast, FIG. 1B illustrates a multi-layer electronic component 120 after successfully completing a polishing process, having generally rounded edges.

Figure 2:
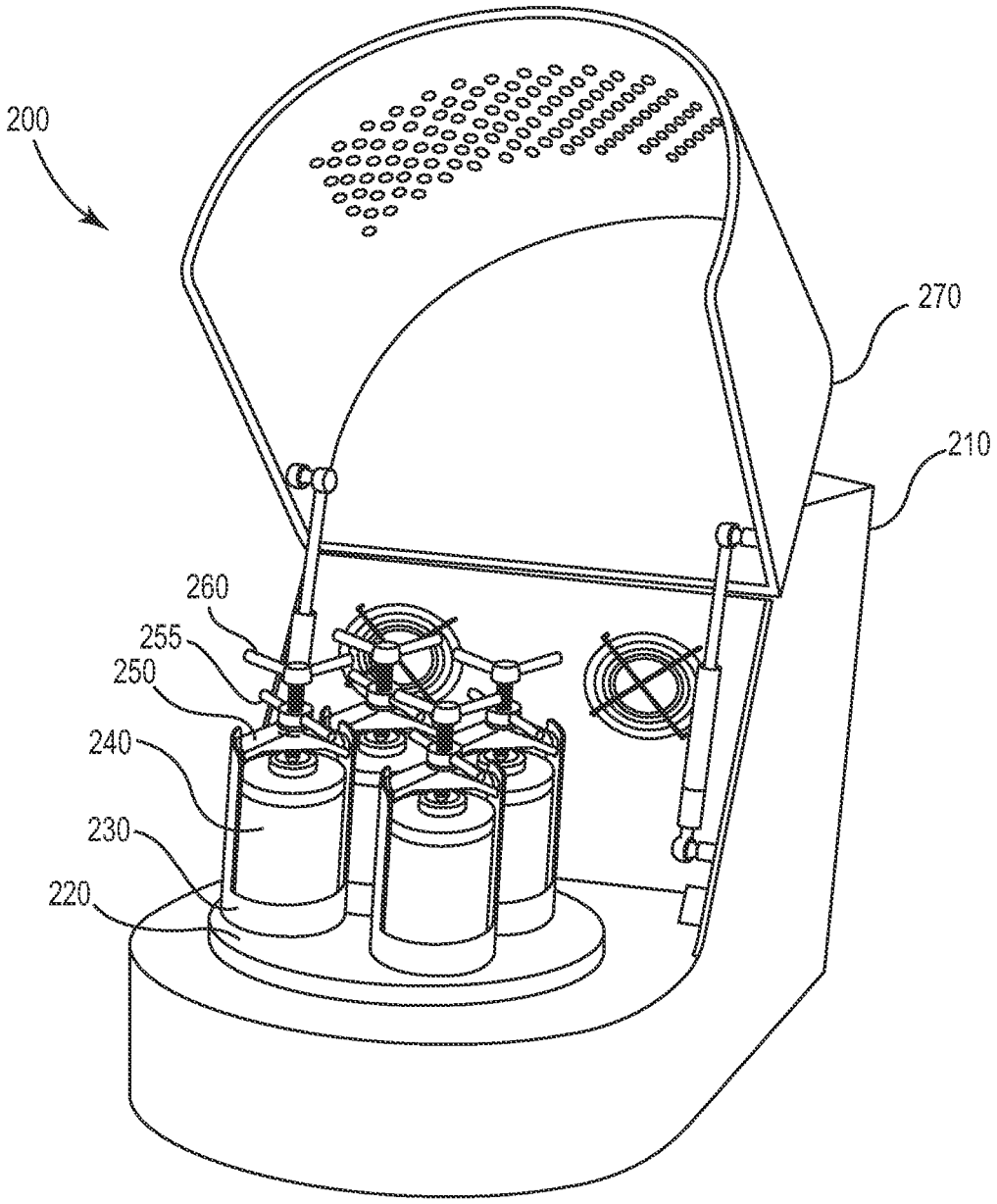
FIG. 2 provides a front view illustration of a vertical planetary ball mill used in one embodiment of the present invention.

FIG. 2 depicts a side view of the structure of an example vertical planetary ball mill 200, the vertical planetary ball mill 200 adaptable for use in one embodiment of the present invention. As illustrated, housing 210 surrounds the motor or other operable rotation driving means. The motor is in turn connected to revolution plate 220, and provides rotation for the revolution plate 220 with a rotating shaft around a generally vertical axis. In this illustrated structure of a vertical planetary ball mill, and as further demonstrated in FIG. 6B, four polishing jar containers such as polishing jar 240 each independently rotate in a direction opposite of the revolution plate. Also in this particular example of mill 200, a safety shield 270 is attached to housing 200 to enable the rotations of the revolution plate 220 and the polishing containers such as container 240 to occur an unobstructed manner.

As further described herein, the polishing jars such as container 240 attached to the revolution plate are each filled with the components to be polished. The jars are affixed to a container holder such as holder 230 which secures the container in place within the mill 200 and enables rotation of the container 240. The containers are sealed through use of beam 250, pressure screw 255, and locking screw 260, which prevents the contents of the containers from escaping during high-speed rotation.

One of the advantages of adapting a vertical planetary ball mill as a polishing device in the presently described invention is that a planetary ball mill requires a simple mechanical transmission device to perform vertical rotation. Additionally, ball mills may be operated in a relatively small space, and provide polishing container units that are easily adapted and replaced for use with a variety of components and polishing media.

Figure 3:
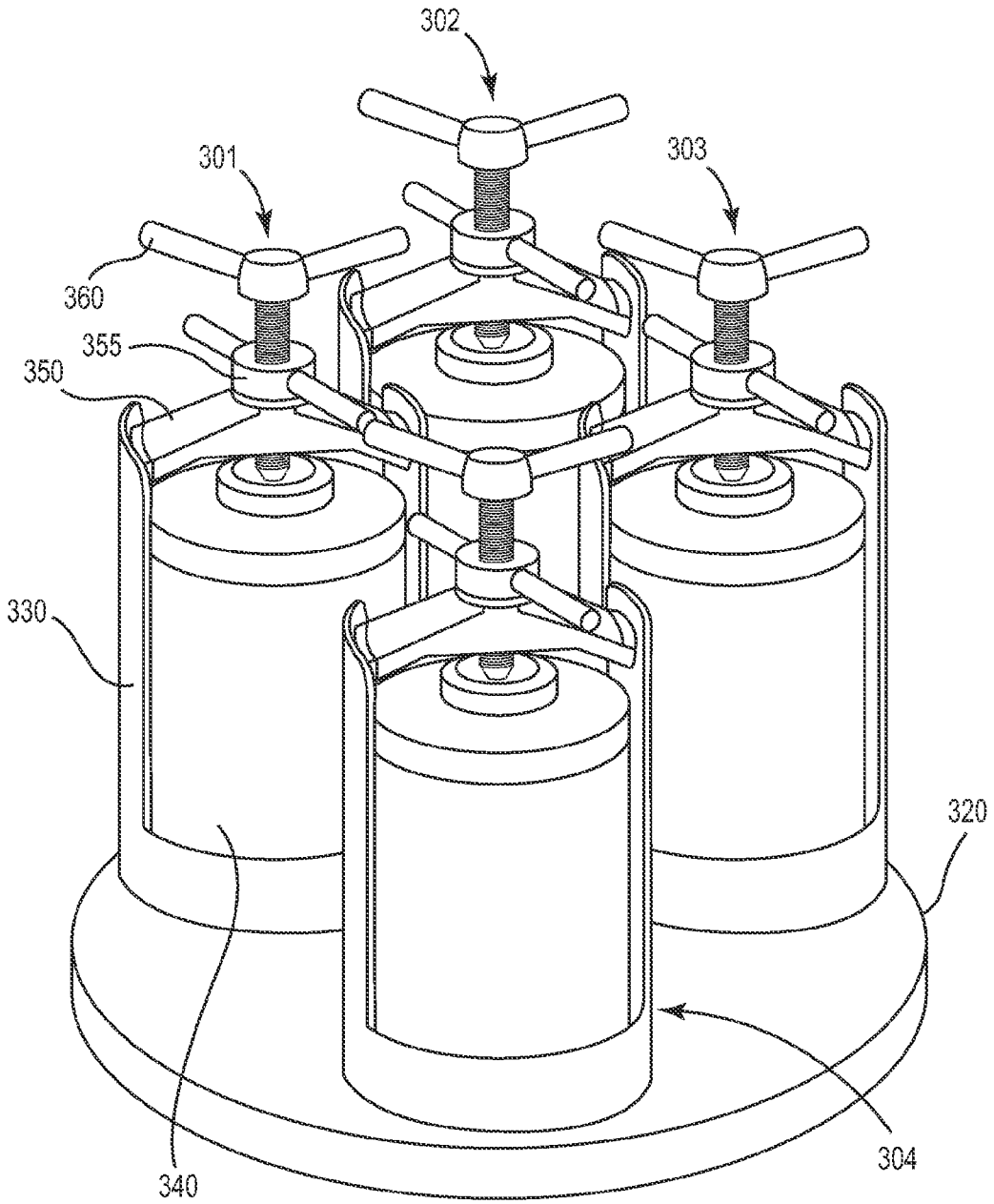
FIG. 3 provides a front view illustration of four containers used within a vertical planetary ball mill adapted for use in one embodiment of the present invention.

FIG. 3 depicts a closer perspective illustration of the individual polishing container units 301, 302, 303, 304 operating within an example vertical planetary ball mill. As depicted, the four polishing units 301, 302, 303, 304 each rotate independently, and are rotated counter to the rotation direction of the revolution plate 320. The polishing container itself such as container 340 is attached within container holder 330, and is sealed with use of beam 350, pressure screw 355, and locking screw 360.

Figure 4A:
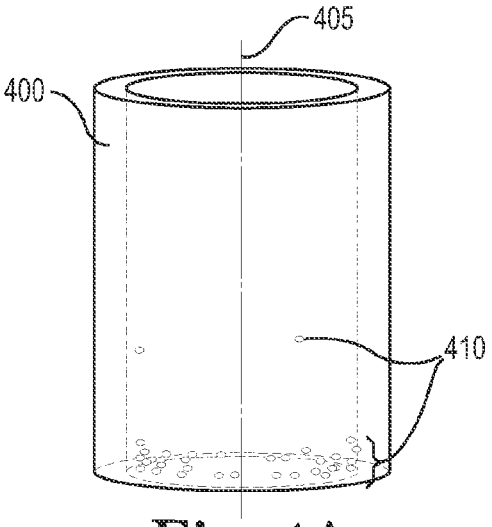
FIG. 4A provides an illustration of the rotation of an unmodified polishing container operated within a vertical planetary ball mill adapted for use in one embodiment of the present invention.

FIG. 4A depicts a cutaway view of a polishing jar container as typically operated in vertical planetary ball mills. As shown, container 400 is commonly structured in a cylinder shape, with an inner side wall of its internal cavity perpendicular to the bottom surface of the container. The container rotates around a vertical axis 405. Components 410 are placed within the container, and as the container rotates, the various components 410 move up and fly throughout the interior of the canister. Exposure of the components to polishing media and the forces within the container results in the rough surfaces of the components to be worn away and polished over time.

Figure 4C:
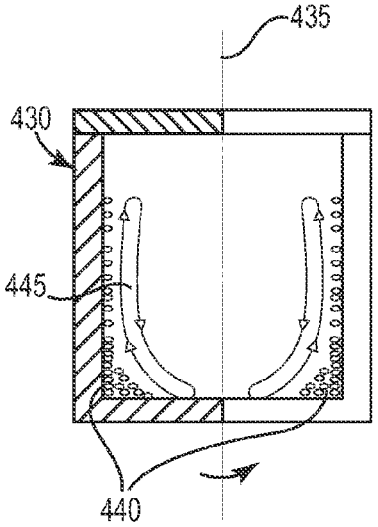
FIG. 4C provides an illustration of the agitation of components within an unmodified polishing container operated within a vertical planetary ball mill adapted for use in one embodiment of the present invention.
Figure 4B:
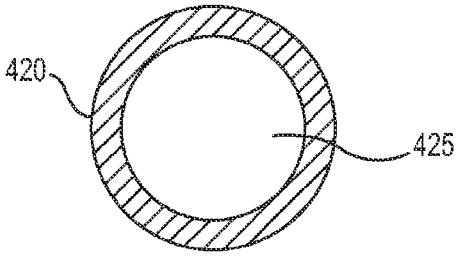
FIG. 4B provides an illustration of the structure of an unmodified polishing container operated within a vertical planetary ball mill adapted for use in one embodiment of the present invention.

FIG. 4B illustrates a horizontal cross-section view of the container shape. Again, as previously described, the outer wall 420 and the interior 425 of the container are structured vertically in a straight, uncurved line. Therefore, the interior side wall of the container is perpendicular to the top and bottom walls of the container and does not transition to any intermediate shapes.

FIG. 4C further shows the rotation of container 430 around a vertical axis 435 that is filled with a number of components for polishing. This illustration demonstrates the limitations of existing vertical planetary ball mills for polishing. The vertical structure of the polishing jar prevents all of the components placed within the polishing jar to fly-up and rotate, and be exposed to polishing media and polishing forces. During the revolution around upright axis 435, only a limited number of components circulate within path 445. As illustrated in FIG. 4C, some components accumulate at corner area 440 which results in uneven polishing within a large batch of components. Further, abrasives placed within the container tend to "freeze" against the jars or containers in an undisturbed equilibrium position, without much relative movements of the components and abrasives.

Thus, although vertical barrel polishing techniques are able to produce a number of polished components in faster time than with horizontal techniques, the shape of the vertical container typically results in incomplete polishing batches for multi-layer electronic components. These limitations are remedied by the various embodiments of the following modified polishing container structures.

Figure 5A:
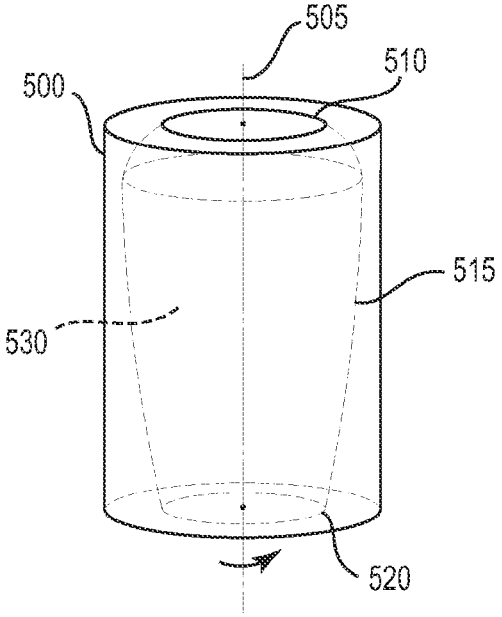
FIG. 5A provides an illustration of the rotation of a modified polishing container operated within a vertical planetary ball mill according to one embodiment of the present invention.

According to one embodiment of the present invention, the containers used within a vertical planetary ball mill or other machine rotating about a vertical axis are structured as follows. FIG. 5A illustrates a modified polishing container 500 configured for rotation about a vertical axis 505. The inner cavity of this container 530, however, is shaped with a smooth interior wall, with an internal diameter that continually varies in a generally curved or sloped manner. As depicted in FIG. 5A, the diameter of the inner cavity of the container at the top 510 and bottom 520 of the container are each smaller than the diameter of the inner cylinder at the central portion of the container 515.

Figure 5C:
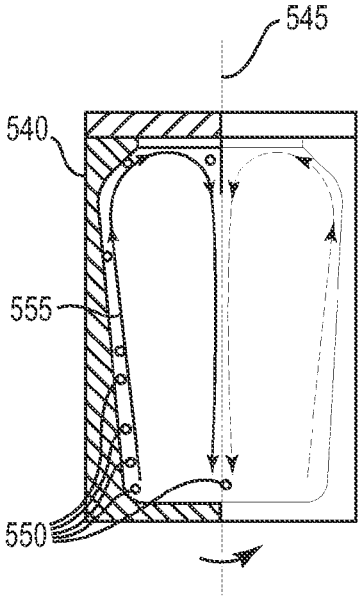
FIG. 5C provides an illustration of the agitation of components within an modified polishing container operated within a vertical planetary ball mill according to one embodiment of the present invention.
Figure 5B:
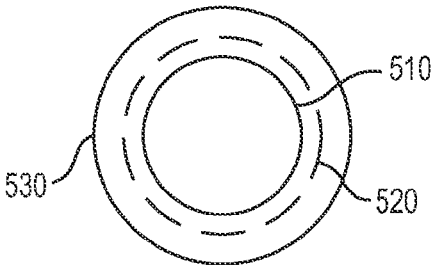
FIG. 5B provides an illustration of the structure of a modified polishing container operated within a vertical planetary ball mill according to one embodiment of the present invention.

FIG. 5B illustrates a horizontal cross-section view of this modified container cavity. This figure illustrates that the diameter is larger at central section 530 and becomes smaller towards both the top 510 and bottom 520 of the cavity. As shown, the top 510 and bottom 520 of the cavity do not necessarily have the same diameter, such as in cases where the container opening at the top 510 is fairly narrow. The cross-sectional shape of the inner cavity is generally structured in a circle instead of a square, hexagon, octagon, or other polygonal shape having corners. A generally smooth circular shape reduces the chance that components will strike the corners of the container and crack. This is particularly important for polishing electronic chip components, especially those made of ceramic, to prevent components from hitting the interior container edges and cracking during the polishing process.

Additionally, as is shown in FIG. 5A, the interior cavity of the polishing container may be structured to have a flat-bottom 520. Having a flat bottom to the polishing container enables a stable high speed rotation of the container about the container rotation axis.

FIG. 5C demonstrates the rotation of the container 540 about a vertical axis 545 when filled with components 550 to be polished. In operation, the container is held in place by a container holder as the rotation plate connected to the container holder revolves around a plate axis. This rotation is depicted more clearly in FIG. 6B. As shown in FIG. 5C, during rotation components 550 are widely distributed throughout the container, and travel generally along the gradually sloping outer wall of the inner cavity as in 555. The inner bottom of the cavity abuts against side walls that have upward sloped edges, thereby enabling components to fly up during high-speed rotation. Accordingly, with the improved circulation of the components throughout the inner cavity, uniform polishing can be achieved for all of the components placed within the container.

Figure 6B:
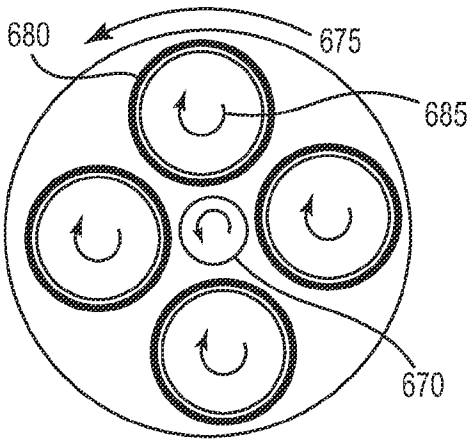
FIG. 6B provides a top view illustration of polishing container and revolution plate rotation in a vertical planetary ball mill adapted for use in one embodiment of the present invention.
Figure 6A:
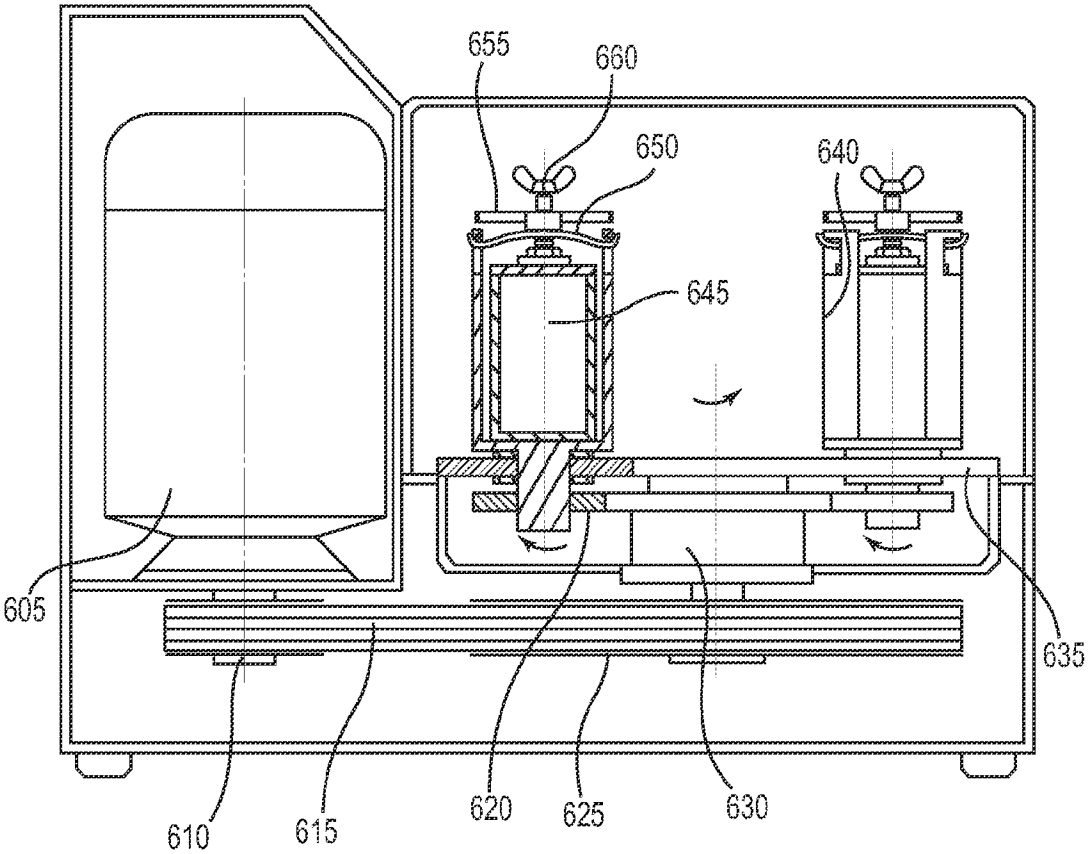
FIG. 6A provides a side view illustration of a vertical planetary ball mill adapted for use in one embodiment of the present invention.

FIG. 6A depicts a side view illustrating the mechanical operation of an example vertical planetary ball mill used in conjunction with the various embodiments of the present invention. Motor 605 drives fixed gear 630 to rotate the revolution plate 635 clockwise (or counter-clockwise) via V-belt 615, small pulley 610 and big pulley 625. Then fixed gear 630 passes momentum to the planetary gear 620 which will provide counter-clockwise (or clockwise) rotation to the individual container units (such as the unit containing container 645). Motor 605 controls the direction, speed, and time of rotation within the planetary mill.

FIG. 6B therefore presents a top view depicting the rotation direction 675 of the revolution plate rotational structure 670 with each of the polishing containers such as container 680 rotating in an opposite direction 685. Thus, if the revolution plate 670 operates counterclockwise, each of the four containers such as containers 680 will rotate in a clockwise fashion along the same vertical axis.

Returning to FIG. 6A, pressure screw 660, locking screw 655 and beam 650 ensure that the polishing jar containers 645 cling to container holders 640 and remain sealed and stable during the high-speed polishing process. As previously described, the components intended for polishing are filled in the interior of the polishing jars 645. Polishing media such as zirconia and liquids might be filled in together as well, depending size, hardness, and quantity of the components to be polished.

The hermetic (i.e., sealed) construction of the vertical planetary ball mill polishing containers provides the flexibility for both wet and dry type polishing. Particularly, one advantage of using a sealed polishing jar is that wet-barrel polishing methods with water may be carried out. Wet-barrel polishing methods with water or other suitable liquids may be placed within some or all of the vertical planetary ball mill containers. Such liquids may used as part of the barrel polishing process to assist with the polishing process, such as serving as shock-absorbing material to reduce impact force during rotations.

The use of liquids within the containers will reduce or entirely prevent cracking of the components caused by collisions of components themselves and collisions of components and abrasives during the polishing process. However, water and similar liquids may not be applicable for all types of electronic components, because water tends to move in through the interfaces between the internal electrodes and ceramic or magnetic layers and cause delamination. Those skilled in the art would recognize which liquids are most appropriate for the particular component and polishing application.

As suggested above, a vertical planetary ball mill is a relatively simple mechanical transmission device, but provides advantages for use with the presently described embodiments due to its lower center of gravity and more compact structure than other vertical polishing devices. Further, the polishing containers provided by the present invention may be used with existing vertical planetary ball mill structures, such as the structures shown in FIGS. 2-3, or can be adapted for use in other configurations of high-speed polishing devices.

As a further explanation, although the internal wall of the polishing container 645 shown in FIGS. 6A and 6B has the same width from the top to the bottom of the container, this provides an illustration of only one of many configurations. In other embodiments of the present invention, polishing container 645 may have a continuously varied internal diameter, such as by dividing the polishing container 645 into a first section and second section through the internal diameter, with the first section defined between the first end of polishing container 645 (the end proximate to revolution plate 635) and the widest point existing between the first end and the second end (the end apart from revolution plate 635), and the second section defined between the widest point and the second end, wherein the second section and the first section have an opposite incline direction, e.g. as shown in FIG. 5A.

Figure 7:
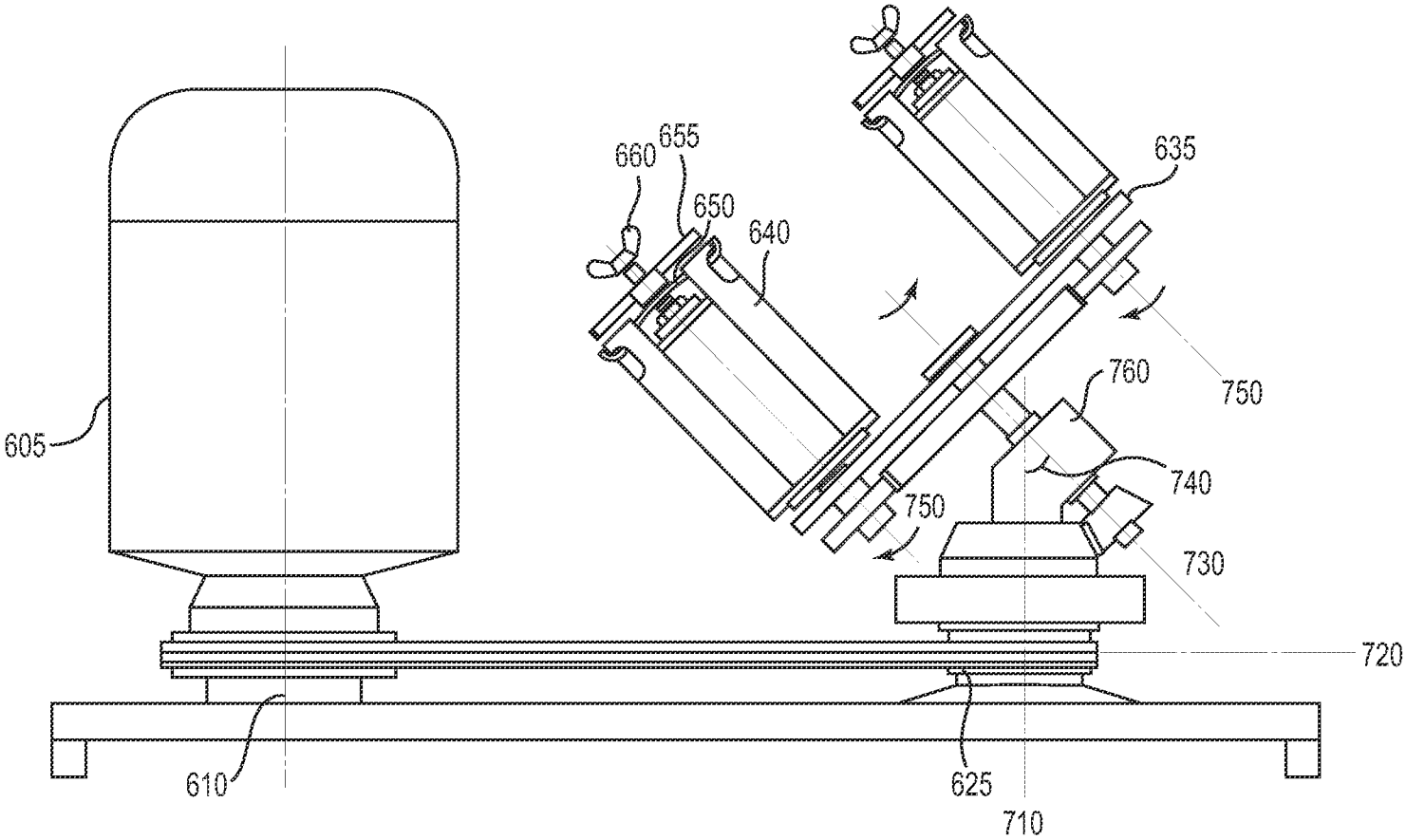
FIG. 7 provides a side view illustration of a vertical planetary ball mill operating polishing containers at a tilted angle according to one embodiment of the present invention.

FIG. 7 depicts operation of the vertical planetary ball mill polishing device of FIG. 6A operating its polishing containers around tilted axes according to a further embodiment of the present invention. As shown, the rotation shaft provides rotation for the revolution plate about a tilted revolution axis 730 and the containers around a parallel tilted container axis 750, each of the tilted axes positioned between a vertical axis 710 and a horizontal axis 720.

As shown, the revolution plate 635 and polishing containers such as 640 are coupled to a rotating shaft or member that is in turn connected to a base support further referred to as support member 760. The first end (i.e., the top) of the support member 760 is coupled to the revolution plate 635 at a different angle than the second end (i.e., the bottom) of the support member 760 that is coupled to the planetary ball mill assembly. Therefore, as shown, the tilted axis 730 extends through the first end of the support member 760 that is proximate to the revolution plate. The vertical axis 710 extends through the second end of the support member 760 that is distal to the revolution plate 635. Thus, as illustrated in FIG. 7, the vertical axis 710 may be substantially perpendicular to a bottom surface of the second end of the support member 760.

The specific "tilted" angle 740 of operation for the revolution plate 635 and containers such as 640 therefore is the angle existing between the vertical axis 710 and the tilted axes 730 and 750. In one embodiment, the optimal angle 740 for operation of the polishing device is at an acute 45 degree angle between these axes. Those skilled in the art would recognize that other angles of operation between 0 and 90 degrees could be used in conjunction with the embodiments of the present invention described above to achieve the advantages of operating at a tilted angle.

Rotation around a tilted axis helps reduce the accumulation of components at the bottom and increases relative movements, and therefore helps to obtain uniform polishing of components in a shorter amount of time. Additionally, rotation around a tilted axis instead of a horizontal axis reduces gravitational pull and overall collision forces that would otherwise be encountered during the barreling process. This reduces cracking and damage to sensitive components that would otherwise occur in entirely vertical or horizontal angles.

Although the terms "vertical" and "horizontal" have been used to describe the orientation of various axes in the operation of the polishing device and containers, these orientations are presented merely for purposes of example and not limitation. Thus, the position and orientation of the polishing device and containers may be changed such that that the axes presented herein are no longer "vertical" or "horizontal" while not departing from the intended scope of the present invention.

Moreover, although various representative embodiments of this invention have been described above with a certain degree of particularity, those skilled in the art could make numerous alterations to the disclosed embodiments without departing from the spirit or scope of the inventive subject matter set forth in the specification and claims.

What is claimed is:

1. A method for polishing components within a high speed barrel polishing device, comprising:

securing a plurality of polishing containers within container holders;

placing components in the plurality of polishing containers, the plurality of polishing containers used for polishing the components placed therein, and each of the polishing containers structured for rotation around a corresponding container axis in a first direction, wherein each of the corresponding container axes are parallel to a revolution plate axis, and wherein each of the plurality of polishing containers comprises:

an interior cavity having a first end and a second end, the interior cavity between the first end and the second end being defined by a smooth interior wall, and the interior cavity having an internal diameter that continuously varies with a gradual transition between the first end and the second end; and rotating a revolution plate around the revolution plate axis in a second direction, the revolution plate coupled to the containers on a first side of the revolution plate. wherein the coupling rotates each container around the corresponding container axis in the first direction of rotation, thereby polishing the components placed within the polishing containers, wherein the revolution plate axis is perpendicular to the first side of the revolution plate, and wherein the first direction of rotation is opposite the second direction of rotation.

2. The method of claim 1, further comprising adding one or more dry abrasives to one or more of the polishing containers.

3. The method of claim 1, further comprising adding a liquid to one or more of the polishing containers and sealing the one or more polishing containers.

4. The method of claim 1, further comprising a support member coupled to the revolution plate, the support member configured with a first axis and a second axis, and positioning at least two of the polishing containers for operation at a tilted angle using the support member, wherein each polishing. container axis and the first support member axis are parallel to the revolution plate axis, and wherein the second support member axis is not parallel to the revolution plate axis, and wherein the tilted angle is the angle defined between the second support member axis and the revolution plate axis.

5. The method of claim 4, wherein the tilted angle is substantially 45degrees.

6. The method of claim 1, wherein the components are multi-layer electronic components including one or more of inductors, beads, capacitors, and oscillators.

* * * * *